United States Patent [19]

Steinberg

[11] Patent Number: 4,834,376

[45] Date of Patent: May 30, 1989

[54] BASEBALL BAT WITH IMPACT INDICATOR

[75] Inventor: Gerald Steinberg, Huntingdon Valley, Pa.

[73] Assignee: Nasta Industries, Inc., New York, N.Y.

[21] Appl. No.: 107,937

[22] Filed: Oct. 13, 1987

[51] Int. Cl.[4] ..... A63B 69/00

[52] U.S. Cl. ..... 273/26 B; 273/186 A; 73/570

[58] Field of Search ..... 273/26 B, 29 A, 72 R, 273/73 R, 77 R, 81 R, 183 D, 181 R, 181 H, 186A; 73/1 B, 570, 576, 578

[56] References Cited

U.S. PATENT DOCUMENTS

| | | | |
|---|---|---|---|
| 2,986,937 | 6/1966 | Chapman | 273/186 A |
| 3,122,365 | 2/1964 | August | 273/26 B |
| 3,270,564 | 9/1966 | Evans | 273/186 A |
| 3,318,602 | 5/1967 | Kunihisa | 273/186 A |
| 3,380,305 | 4/1968 | Charell | 273/26 B |
| 3,436,676 | 4/1969 | Barthol | 273/26 B |
| 3,538,756 | 11/1970 | Coombs | 73/578 |
| 4,222,562 | 9/1980 | Hefter et al. | 273/29 A |
| 4,257,594 | 3/1981 | Conrey et al. | 273/26 B |

*Primary Examiner*—Richard C. Pinkham
*Assistant Examiner*—T. Brown
*Attorney, Agent, or Firm*—Lackenbach, Siegel, Marzullo & Aronson

[57] ABSTRACT

Within a bat handle a resiliently mounted magnet oscillates when the bat strikes a ball. The magnetic field couples with a fixed inductive coil inducing a signal with an amplitude proportional to the impact force. The signal is processed to provide an indication on the bat of the force of impact.

12 Claims, 4 Drawing Sheets

BASEBALL BAT WITH IMPACT INDICATOR

BACKGROUND OF THE INVENTION

This invention relates generally to a device to measure impact forces between two objects and more particularly to a baseball bat having an indicator of impact force with a baseball. Baseball players, when hitting a baseball with a bat, generally desire to make solid impact with the ball. The velocity of the ball and the trajectory and distance traveled by the ball are dependent upon the mass, and its velocity, which strikes the ball and the player's ability to hit the ball "solidly". Bat contact which is too low or too high on the ball results in inefficient transmission of bat momentum to the ball. Thus, the player with the greatest physical strength may not be the player who hits the ball fastest and farthest.

As an adjunct to developing a good swing with the bat, or as a toy in a game to see who is the strongest hitter, there is nothing presently available to indicate the force of impact between bat and ball other than the distance traveled. This is not a reliable indicator when the ball is hit and strikes the ground early as in a ground ball or in situations such as in a batting practice arrangement where the ball is hit into a net and actual distance of travel is not determined.

What is needed is a device for indicating the force of impact between bat and ball regardless of subsequent travel of the ball.

SUMMARY OF THE INVENTION

Generally speaking, in accordance with the invention, a baseball bat is provided which contains within it electronic means for determining the magnitude of impact between bat and ball and for providing a visual indication on the bat of such impact magnitude.

Within the bat handle a magnet is resiliently mounted such that it oscillates when the bat strikes a baseball. Striking the baseball momentarily, albeit visually imperceptible, slows the bat's motion. However, the resiliently mounted magnet tends to continue the oscillatory motion imparted to it by the bat impact. The greater the transmission of force from bat to ball, the greater is the amplitude and duration of magnet oscillation until the oscillations are naturally dampened.

The magnet is positioned for magnetic field coupling with a fixed inductive coil. As the magnet oscillates after impact of bat with ball, an AC signal is induced in the coil by the relative motion between the magnet and coil. The signal has an amplitude proportional to the impact force. The AC signal is then electronically processed to provide an indication of the force of impact. The force indicator is a plurality of lights on the bat handle near the batter's grip. The number of lights which become illuminated upon impact with the ball indicates the force of impact. Light emitting diodes or a liquid crystal display may be used. A battery power source is implanted in the bat handle so that the device is self-powered. Electronic circuits and the magnetic elements are packaged in the handle. The handle is detachable from the remainder or body of the bat which is created especially for this game or may be a conventional bat body which has been cut off from the conventional handle and adapted for use with the handle of this invention. Models can be provided for adults and for children by selection of the resilient mounting for the magnet. Thus such a baseball bat may be considered as a training device or as a toy.

Accordingly, it is an object of this invention to provide an improved baseball bat which provides impact force indication to be used in developing batting skills or as a game.

Another object of this invention is to provide an improved baseball bat which has the look and feel of a conventional baseball bat while providing indication of impact force between bat and ball.

A further object of this invention is to provide an improved baseball bat which provides a lingering indication of impact between bat and ball.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 3:
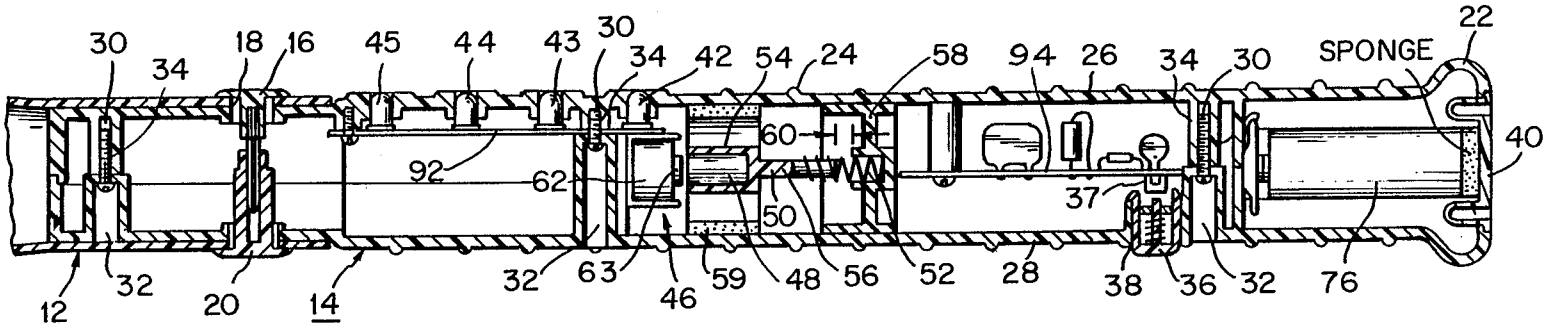
FIG. 3 is a cross-sectional view of the handle of FIGS. 1 and 2 indicating positioning of magnetic and electrical components and a connection between a bat body and bat handle.

With reference to the Figures, the bat 10 in accordance with the invention includes a body 12 and a handle 14 having the dimensions of a conventional baseball bat or in an alternative embodiment in accordance with the invention being scaled down for use by children and teenagers. As best illustrated in FIG. 3, the handle 14 is basically a hollow shell filled with electronic and electromagnetic elements which are explained more fully hereinafter. The illustrated bat body 12 is also hollow and is connected to the handle 14 with a telescopic fit over the handle 14. A retaining pin assembly 16 passes through the overlapping portions of the body 12 and handle 14 to prevent rotation of the body 12 relative to the handle 14 and also to prevent longitudinal slippage between the body 12 and handle 14. The retaining pin assembly 16 is comprised generally of a male element 18 pressed into a female element 20, each element having an enlarged head which is visible on the surface of the bat 10. The connection between the elements of the retaining pin assembly 16 may be a press fit between the elements 18, 20 as described or the element 20, in an alternative embodiment may be threaded to the element 18. The bat body may be of aluminum as is popular in many conventional bats today or it may be a wooden bat which has been shortened and hollowed out near the handle end for attachment to the bat handle 14 in accordance with this invention. The bat body may also be of plastic as in conventional plastic toy bats. Construction of the bat body 12, other than its attachment to the bat handle 14 in accordance with the invention, is not considered to be a novel portion of this invention and accordingly is not described in more complete detail herein.

Externally, the bat handle is dimensioned as a conventional bat or as a scaled down bat for children or teenagers and includes a flair 22 at its free end and protrusions 24 to enhance the batter's grip in striking the ball with the bat 10.

The handle 14 is made of two halves 26, 28 held together by screws 30 received in recesses 32 and engaging threaded receiving portions 34 in the handle half 26. An ON/OFF button 36 protrudes slightly from the underside of the handle 14 passing through an opening 38 in the lower half 28 of the handle 14. A battery cover 40 closes an opening through which a battery 76 may be installed at the free extremity of the handle 14.

The ON/OFF button 36 is positioned on the handle 14 where a person gripping the bat to hit a ball will squeeze the button in the process of holding the bat. Also visible on the handle, near the juncture with the body 12, are a plurality of indicators 42–45 as described more fully hereinafter. Indicator 42 presents an ON state for a low impact hit with a ball, a higher impact turns indicators 42 and 43 ON; an even greater impact turns on indicators 42–44, and indicators 42–45 indicate On for an even greater impact. In baseball terms it can be considered that indicator 42 indicates a single; indicators 42, 43 combined indicate a double, indicators 42–44 combined indicate a triple and all four indicators in the ON state after impact indicate a home run. If desired a threshold impact may be required below which no indicator turns ON even when some impact is made.

Figure 1:
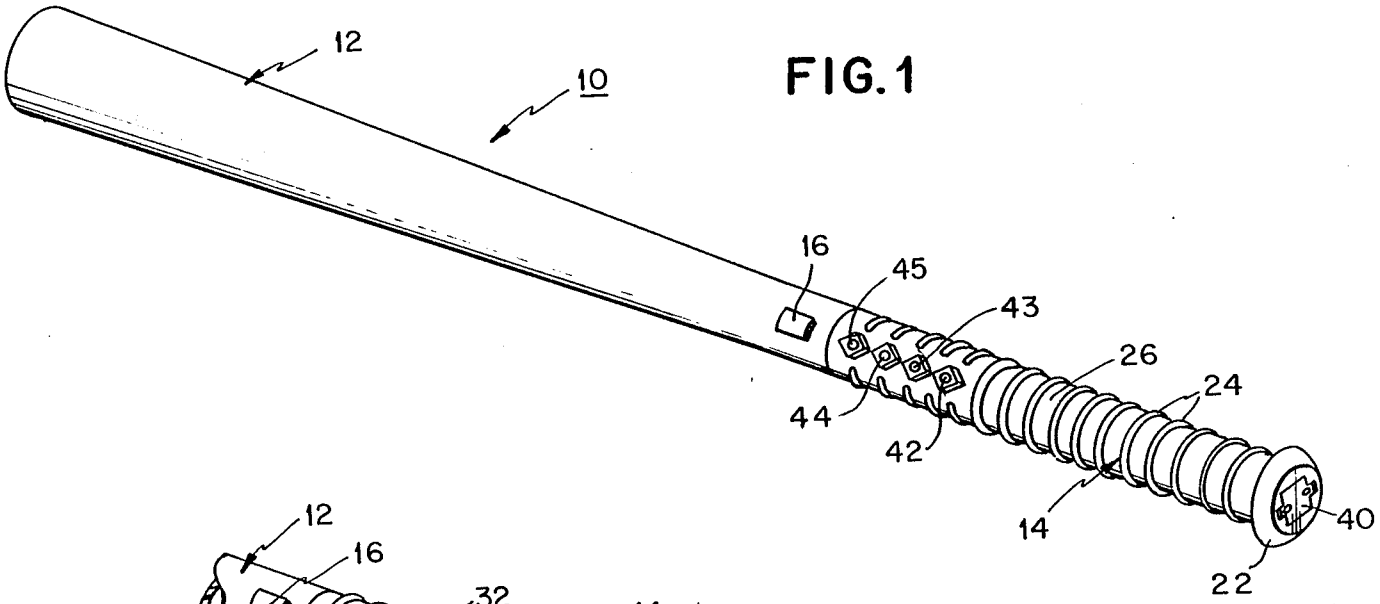
FIG. 1 is a top perspective view of a baseball bat with impact indicator in accordance with the invention.
Figure 2:
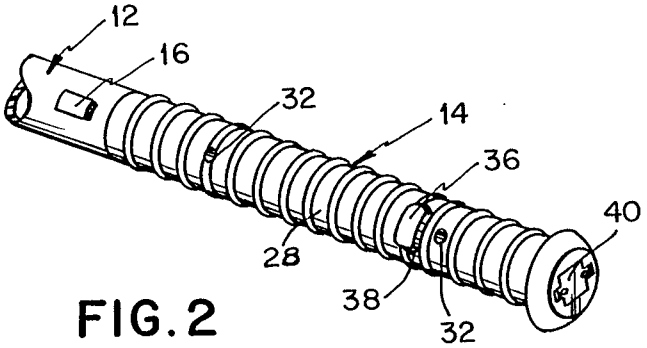
FIG. 2 is a partial bottom perspective view of the baseball bat of FIG. 1 showing the handle.

The indicators are LED, light emitting diodes, which in the ON state light up. Different colors are commercially available and a variety of colors may be used on one bat 10 or a single color may be used for the bat 10. In an alternative embodiment, a liquid crystal display may be employed, and any form of indicator which is constructed to define gradations of impact force may be used in accordance with the invention. Although the indicators are illustrated in FIG. 1 in a linear pattern they may be arranged in alternative embodiments in accordance with the invention, for example, at the corners of a diamond such that their illumination indicates a single, double, triple or home run. Also, when using such a display as a diamond, a single can cause illumination of a line from home plate to first base; a double can illuminate a line from home plate to second base by way of first base, etc., etc.

Figure 4:
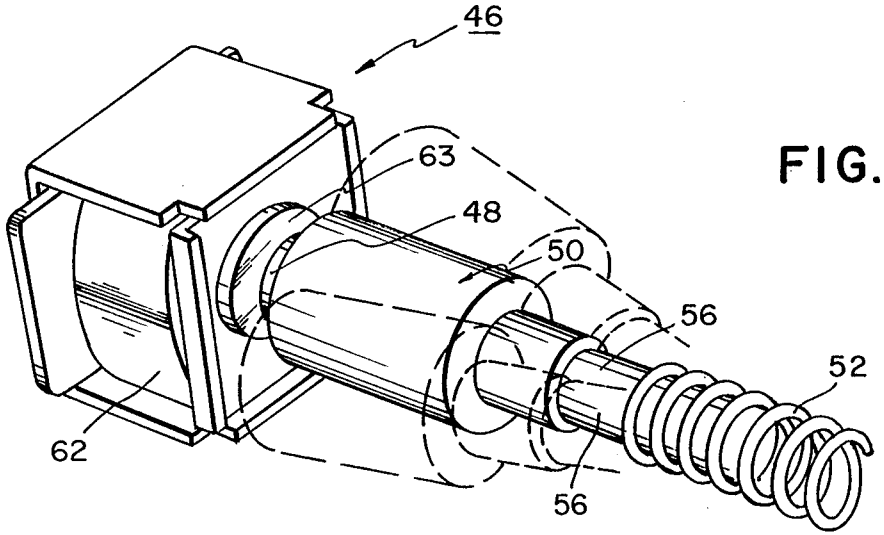
FIG. 4 is a perspective view to an enlarged scale of the magnetic impact detector.

FIG. 4 illustrates an impact transducer 46 which converts impact of the bat 10 with a baseball into an electrical signal. The transducer 46 includes a permanent magnet 48 (FIG. 3) which is attached to a magnet holder 50. The magnet holder is generally cylindrical, being reduced in a step from a diameter corresponding with the magnet diameter to a lesser diameter suitable for engagement within a coiled retaining spring 52. As illustrated in FIGS. 3 and 4, the magnet 48 is recessed within the forward portion 54 of the holder 50 and the small diameter end 56 of the magnet holder 50 inserted into the retaining spring 52 extending only part way along the spring length.

A spring retainer 58 receives the free end of the retaining spring 52 and is fixed in position between the assembled handle halves 26, 28. A gap 60 separates the end of the magnet holder 50 and the spring retainer 58. Thus, the magnet 48 is free to swing on the spring 52 in any direction, that is as a pendulum going back and forth in any direction or in a circular motion or any combination of linear and circular motions. Such motion is indicated with the broken lines in FIG. 4. The amplitude of the motion will depend upon the impact of the bat against ball and the resilience of the retaining spring 52 which has been selected and of course the length of the gap 60. A single impact induces an oscillation which is damped out by the spring 52. The frequency of oscillation depends upon parameters involving the mass of the system and the spring constants.

A pick up coil 62 is positioned adjacent the end of the permanent magnet 48 such that when the magnet moves on the spring 52, the magnetic field cuts the windings of the pick up coil and induces a voltage therein. Due to the oscillatory action of the magnet 48, an AC signal is induced in the coil 62. The amplitude of the induced signal depends upon motion of the magnetic flux relative to the coil wires and this in turn is related to the force of impact with the ball.

A steel disk 63 centrally mounted on the face of the pick up coil 62 attracts the permanent magnet 48 and maintains it in a centered position absent an impact on the bat. The magnet 48 and a portion of the magnet holder 50 move in a chamber lined with sponge 59 to prevent contact between the magnet holder 50 and the inner surfaces of the handle halves 26, 28 during magnet deflection upon high impact.

Figure 5:
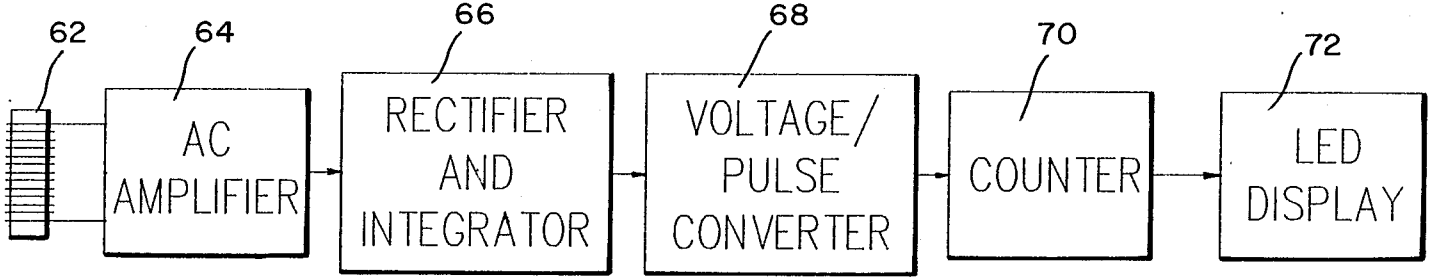
FIG. 5 is an electrical block diagram of circuitry for the bat in accordance with the invention.

As illustrated functionally in FIG. 5, the signal from the coil 62 is amplified in AC amplifier 64. The amplified signal is rectified and the resultant DC signal is integrated 66. Thus a DC signal is produced having a magnitude directly related to the impact of the ball with the bat and the signal induced by the oscillating magnet. A pulse converter 68 outputs voltage pulses in a quantity dependent upon the input voltage level. At standby conditions the pulse converter 68 outputs no pulses.

A counter 70 counts the pulses from the pulse converter 68 and drives a display 72, the number of indicators 42–45 which are turned ON depending upon the count accumulated in the counter 70.

Figure 6:
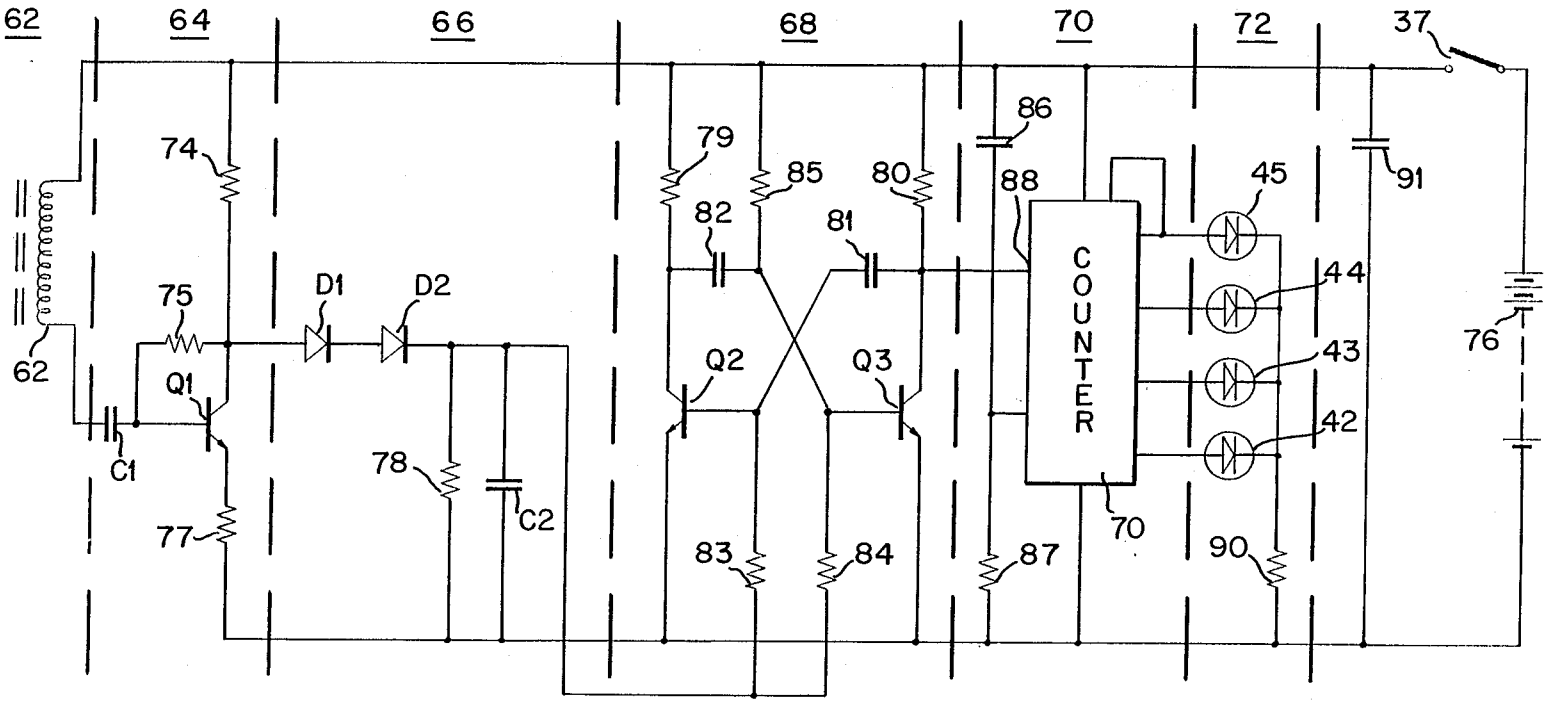
FIG. 6 is a circuit schematic for the impact indicator in accordance with the invention.

Referring to the circuit diagram of FIG. 6, an AC voltage is induced into the coil 62 by impact induced motion of the magnet 48. One end of the coil 62 connects to the collector of a transistor Q1 via a resistor 74. The other end of the coil connects to the base of the transistor Q1 via a capacitor C1. A resistor 75 connects between the transistor base and collector. The emitter of the transistor Q1 connects to the low end of a battery 76, typically 9 volts, through a resistor 77. A pair of diodes D1, D2 in series connect between the transistor collector and a parallel arrangement of a capacitor C2 and a resistor 78. The other terminals of the resistor 78 and capacitor C2 connect to the low end of the battery 76.

A pair of transistors Q2, Q3 have their collectors connected to the high side of the battery 76 through the resistors 79, 80 respectively. The transistor emitters connect directly to the low side of the battery 76. The base of the transistor Q2 is connected by way of a capacitor 81 to the collector of the transistor Q3. The base of the transistor Q3 connects to the collector of the transistor Q2 by way of the capacitor 82. The bases of both transistors Q2, Q3 connect to the voltage potential of the capacitor C2 at the common connection with the diode D2 and resistor 78 by way of resistors 83, 84 respectively. The base of transistor Q3 connects to the high side of the battery 76 by way of resistor 85. The circuit elements identified by the reference numerals 79–84 and transistors Q2, Q3 comprise the voltage/-pulse converter 68 of FIG. 5.

A capacitor 86 and resistor 87 in series are positioned in parallel across the battery 76 and an integrated circuit counter 70 is also connected across the battery 76. The input 88 to the counter 70 is connected to the collector of the transistor Q3. The outputs of the counter 70 connect respectively to light-emitting diodes 42–45 through a current limiting resistor 90. A capacitor 91 across the battery 76 provides filtering. The ON/OFF button switch 36 with contacts 37 is in the line between the high side of the battery 76 and the remainder of the circuitry. All of the aforementioned connections to the high side of the battery, and circuit operation, are contingent upon the switch contacts 37 being closed.

As illustrated in FIG. 3, the battery 76 is loaded into the bat handle 14 from the rear end 22 by removal of the battery cover 40. The light emitting diode indicators 42–45 are mounted on a printed circuit board 92 within the handle 14. The remaining electronic components are mounted on printed circuit board 94.

The handle halves 26, 28 are fabricated of metal or plastic elected and dimensioned to give proper weight and feel to the bat 10. If necessary, weights can be applied in the bat body 12 and handle 14 for such purposes.

Operation of the bat and the circuit are as follows:

The bat is held by the handle in a conventional manner. When the handle 14 is grasped the ON/OFF switch button 36 is depressed and thereby the switch 37 is closed applying the potential of the battery 76 to the circuit. The four indicator lights 42–45 are not ON. However, the bat is ready for use. While hitting the ball, the switch button 36 is maintained depressed. The ball may strike any portion on the circumference of the bat body 12. When the bat hits a pitched ball, the impact between the bat and ball causes a slight interruption in the motion of the bat. As a result the magnet moves from its original position relative to the "fixed" components, that is, the spring retainer 58 and pick up coil 62.

As a result the magnetic field of the magnet 48 moves relative to the coil 62 and induces a voltage therein. The amplitude of voltage is proportional to the rate of motion of the magnetic field past the coil and therefore induced voltage is proportional to the impact force between the bat and ball. If the impact is very strong, the disruption of bat movement and displacement of the magnet from its standby position will be faster and further so that the voltage induced in the coil is higher. Because the spring vibrates for a short time after impact, the induced coil voltage is a decaying AC voltage. It should be understood that resilience of the spring 52 and attraction between the magnet 48 and disk 63 are such that a normal swing of the bat without impacting the ball will not cause sufficient displacement, if any, to activate the counting circuit as described more fully hereinafter.

The AC signal on the coil 62 is coupled to the base of the transistor amplifier Q1 by way of the capacitor C1. The signal is amplified by the transistor Q1 and the amplified signal is rectified by the diodes D1, D2 so that the capacitor C2 is charged rapidly each time the voltage at the collector Q1 increases. However, discharge of the capacitor C2 is through the resistance 78 and the discharge rate is slower than the charging rate. In this way the capacitor C2 acts as an integration circuit which charges up to a voltage level proportional to the AC voltage amplified by the transistor Q1. Therefore, the DC voltage level on the capacitor C2 is proportional to the AC voltage induced in the coil by impact of the bat.

The transistors Q2, Q3 are connected as a multivibrator. In a standby state with the switch 37 closed, the multivibrator is stable with transistor Q3 continuously conducting and transistor Q2 cut off. The input 88 to the counter is at a low level. When the voltage on the capacitor C2 exceeds a threshold level, which represents a minimum impact qualifying as a "hit", the multivibrator goes into a free running mode with the voltage at the collector of the transistor Q3 switching between high and low levels. Each high at the collector of the transistor Q3 provides an input pulse to the counter 70. The number of counts determines how many of the indicators 42–45 are turned ON in progression. Counting stops when the multivibrator stops cycling which occurs when the voltage on the capacitor C2 bleeds off through the resistance 78. After the count has been made and the proper number of indicators 42–45 have been turned ON, the indicators remain ON until switch button 36 is released. Thus, opening switch contacts 37 and closing them effects a reset of the circuitry which is then ready for the next impact measurement. Frequency of the multivibrator is directly related to the voltage on the capacitor C2. A multivibrator circuit having components sized for cycling at four cycles per second in conjunction with a capacitor C2 and resistance 78, which discharges the capacitor C2 in one second, can be used to provide at maximum four inputs to the counter 70 per impact.

It should be understood that whereas the invention is described above as a baseball bat or a toy similar to a baseball bat, in alternative embodiments of the invention, the "bat" can be any device which operates with impact on another object. For example, the invention can be incorporated into a tennis racket. In such an application, the user can determine the effectiveness of different grips in serving, for example, as well as in ground into a hockey stick, golf clubs, paddle ball bat, punching bag, etc.

It will thus be seen that the objects set forth above, among those made apparent from the preceding description, are efficiently attained and, since certain changes may be made in the above construction without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A bat for striking an object comprising:

a body portion constructed for striking said object;

a handle portion for manual gripping of said bat, said handle portion and said body portion being interconnected;

means for detecting impact between said bat and said object, said means for detecting impact being contained in at least one of said body and handle portions, and including a magnet and a coil positioned relative to each other for coupling the magnetic field of said magnet with said coil, one of said magnet and coil being resiliently mounted for motion relative to the other, impact of said bat with said object causing relative motion between said magnet and coil and generating a voltage in said coil;

circuit means operative with said means for detecting impact for producing a signal representative of the magnitude of said impact, said circuit means for producing a signal sensing said voltage generated in said coil, said circuit means converting said coil voltage to said signal proportionate to the magnitude of said impact;

display circuitry including visual indicators for indicating magnitude of said impact, said display circuitry receiving and processing said signal and driving said indicators, said indicators being positioned on said bat, wherein said visual indicators may operate in either an OFF state or an ON state, at least a portion of said indicators going to said ON state after an impact exceeding a selected level of impact, the quantity of said visual indicators going to said ON state being dependent upon the magnitude of said impact signal received and processed by said display circuitry.

2. A bat as claimed in claim 1, and further comprising a switch positioned on said handle portion, said switch being subject to actuation by the user of said bat when manually gripping said handle portion.

3. A bat as claimed in claim 1, wherein said visual indicators retain an indication of magnitude of said impact after said impact is completed, and further comprising means for resetting said display circuitry to a standby condition ready for indicating a future impact.

4. A bat striking an object comprising:

a body portion constructed for striking said object;

a handle portion for manual gripping of said bat, said handle portion and said body portion being interconnected;

means for detecting impact between said bat and said object, said means for detecting impact being contained in at least one of said body and handle portions, and including a magnet and a coil positioned relative to each other for coupling the magnetic field of said magnet with said coil, one of said magnet and coil being resiliently mounted for motion relative to the other, impact of said bat with said object causing relative motion between said magnet and coil and generating a voltage in said coil;

circuit means operative with said means for detecting impact for producing a signal representative of the magnitude of said impact, said circuit means for producing a signal sensing said voltage generated in said coil, said circuit means converting said coil voltage to said signal proportionate to the magnitude of said impact;

display circuitry including visual indicators for indicating magnitude of said impact, said display circuitry receiving and processing said signal and driving said indicators, said indicators being positioned on said bat, wherein said display circuitry includes a multivibrator circuit having said signal input thereto, said multivibrator circuit cycling only when said DC signal exceeds a predetermined level, and a counter circuit, said counter circuit receiving output pulses from said multivibrator circuit when said multivibrator circuit cycles.

5. A bat as claimed in claim 4, wherein outputs from said counter circuit drive said visual indicators, the number of pulses input to said counter circuit from said multivibrator circuit determining the number of said indicators turned to the ON condition after said impact.

6. A bat as claimed in claim 5, wherein said signal is DC.

7. A bat as claimed in claim 5, wherein the frequency of said multivibrator circuit is directly related to the magnitude of said input signal.

8. A bat for striking an object comprising:

a body portion constructed for striking said object;

a handle portion for manual gripping of said bat, said handle portion and said body portion being interconnected;

means for detecting impact between said bat and said object, said means for detecting impact being contained in at least one of said body and handle portions; and including a magnet and a coil positioned relative to each other for coupling the magnetic field of said magnet with said coil, one of said magnet and coil being resiliently mounted for motion relative to the other, impact of said bat with said object causing relative motion between said magnet and coil and generating a voltage in said coil;

circuit means operative with said means for detecting impact for producing a signal representative of the magnitude of said impact;

display means including visual indicators for indicating magnitude of said impact, said display means receiving said signal and driving said indicators, said indicators being positioned on said bat, wherein said coil is fixed relative to said body and handle portions, said magnetic being resiliently mounted for motion relative to said coil, said means for detecting impact further including a spring fixed at one end relative to said handle portion, said spring supporting said magnet at the other end thereof.

9. A bat as claimed in claim 8, and further comprising a disk of magnetizable material connected to said coil, said disk of magnetizable material being positioned on said coil to couple with the field of said magnet, said magnet and disk being attracted to each other and maintaining a standby position between said coil and said magnet absent said impact.

10. A bat as claimed in claim 8, wherein said circuit means includes a rectifier providing a DC signal from an AC signal induced in said coil, and an integration circuit for smoothing said rectified DC signal.

11. A bat as claimed in claim 10, wherein said display circuitry includes a multivibrator circuit having said rectified filtered DC signal input thereto, said multivibrator circuit cycling only when said signal exceeds a predetermined level, and a counter circuit, said counter circuit receiving output pulses from said multivibrator circuit when said multivibrator circuit cycles.

12. A bat as claimed in claim 11, wherein outputs from said counter drive said visual indicators, the number of pulses input to said counter circuit from said multivibrator determining the number of said indicators turned to the ON condition after said impact.

* * * * *